US010168074B2

(12) United States Patent
Cho et al.

(10) Patent No.: US 10,168,074 B2
(45) Date of Patent: Jan. 1, 2019

(54) TURN DOWN RATIO (TDR) DAMPER

(71) Applicant: DAESUNG CELTIC ENERSYS Co., Ltd, Eumsung-gun (KR)

(72) Inventors: Sung Tae Cho, Cheongju (KR); Chul Hee Cho, Cheongju (KR)

(73) Assignee: DAESUNG CELTIC ENERSYS CO., LTD, Eumsung-Gun (KR)

( * ) Notice: Subject to any disclaimer, the term of this patent is extended or adjusted under 35 U.S.C. 154(b) by 45 days.

(21) Appl. No.: 15/415,251

(22) Filed: Jan. 25, 2017

(65) Prior Publication Data

US 2017/0219247 A1 Aug. 3, 2017

(30) Foreign Application Priority Data

Feb. 2, 2016 (KR) ..... 10-2016-0012734

(51) Int. Cl.
*F24H 9/20* (2006.01)
*F23D 14/02* (2006.01)
(Continued)

(52) U.S. Cl.
CPC ..... *F24H 9/2035* (2013.01); *F23D 14/02* (2013.01); *F23D 14/60* (2013.01); *F23D 14/62* (2013.01);
(Continued)

(58) Field of Classification Search
CPC ..... F24H 9/2035; F23D 14/02
See application file for complete search history.

(56) References Cited

U.S. PATENT DOCUMENTS 5,054,521 A * 10/1991 Hendrick ..... F16K 3/085 137/625.3
5,088,916 A * 2/1992 Furuhashi ..... F23D 14/60 239/414
(Continued)

FOREIGN PATENT DOCUMENTS

DE 315322 11/1919
DE 10348324 5/2005
(Continued)

OTHER PUBLICATIONS

FR2981863A1—machine translation.*
EPO, the extended European search report of EP 17154135.2 dated Aug. 1, 2017.

*Primary Examiner* — Nathaniel Herzfeld
(74) *Attorney, Agent, or Firm* — Lex IP Meister, PLLC

(57) ABSTRACT

A turn down ratio (TDR) damper which controls an amount of gas and air flowing in the TDR damper and deliver the controlled gas and air to a turbo fan is disclosed. The TDR damper includes: air passages comprising a first air passage and a second air passage, the first air passage and the second air passage separately formed so that the air move through each path; gas passages comprising a first gas passage and a second gas passage, the first gas passage and the second gas passage separately formed so that the gas move through each path; and opening and closing means for opening and closing the second air passage and the second gas passage at the same time. The air passages and the gas passages may be separately formed and reached outlets connected to the turbo fan so that the air and gas may be delivered to the turbo fan through a separate path.

6 Claims, 16 Drawing Sheets

(51) Int. Cl.
*F23N 1/02* (2006.01)
*F23D 14/60* (2006.01)
*F23D 14/62* (2006.01)

(52) U.S. Cl.
CPC ..... *F23N 1/027* (2013.01); *F23N 2035/02* (2013.01); *F23N 2035/12* (2013.01); *F23N 2037/10* (2013.01)

(56) References Cited

U.S. PATENT DOCUMENTS 5,950,664 A * 9/1999 Battaglia ..... F16K 5/0414 137/375
6,206,687 B1 * 3/2001 Redington ..... F23D 14/02 137/625.48
9,429,302 B2 * 8/2016 Arik ..... F21V 23/006
2001/0032947 A1 * 10/2001 Freisinger ..... F16K 31/404 251/30.03
2015/0000775 A1 1/2015 Min et al.
2015/0056563 A1 * 2/2015 Kim ..... F23N 1/027 431/354
2015/0345784 A1 * 12/2015 Lee ..... F23D 14/60 431/89
2016/0061445 A1 * 3/2016 Kim ..... F23N 1/02 431/354

FOREIGN PATENT DOCUMENTS

EP 0614045 9/1994
EP 2813759 12/2014
FR 2981863 5/2013
FR 2981863 A1 * 5/2013 ..... F23K 5/007
JP 58-117913 7/1983
JP 3019479 12/1995
KR 10-2013-0090480 8/2013

* cited by examiner

TURN DOWN RATIO (TDR) DAMPER

CROSS-REFERENCE TO RELATED PATENT APPLICATION

This application claims the benefit of Korean Patent Application No. 10-2016-0012734, filed on Feb. 2, 2016, in the Korean Intellectual Property Office, the disclosure of which is incorporated herein in its entirety by reference.

BACKGROUND OF THE INVENTION

1. Field of the Invention

The present invention relates to a turn down ratio (TDR) damper, and more particularly, to a TDR damper which may efficiently deliver gas and air while controlling an amount of gas and air supplied to a burner such as a boiler or a water heater.

2. Description of the Related Art

In general, a burner such as a boiler and a water heater used when using cold water and hot water may include an oil boiler, a gas boiler, an electric boiler, and a water heater according to supplied fuel and may be used for various purposes according to an installation condition. Generally, in such burners, in particular, a gas boiler and a water heater, a Bunsen burner or a premixed burner is used to burn gas fuel. Here, a combustion process of the premixed burner is carried out in such a way that gas and air is mixed with the mixture ratio in an optimal combustion condition and then the mixture air (gas+air) is supplied.

In addition, a performance of a burner is evaluated by a Turn Down Ratio (TDR). The TDR is the 'ratio of the maximum gas consumption to the minimum gas consumption' in gas burners in which an amount of gas is variably controlled. For example, when the maximum gas consumption is 50,000 kcal/h and the minimum gas consumption is 10,000 kcal/h, the TDR is 5:1.

In a gas boiler and a water, when the TDR increases, convenience in heating and a use of hot water increases. That is, when a burner is operated in a low TDR (that is, the high minimum gas consumption) and low load of heating and hot water, the burner is frequently turned on and off. Accordingly, a temperature deviation increases while controlling and durability of the burner decreases. In order to improve such matter, various methods to increase the TDR of the burner have been developed. One of the methods is disclosed in Korean Patent Publication No. 10-1308936 (hereinafter, referred to as 'prior art').

FIG. 1 illustrates moving paths of gas and air in a prior art.

Referring to FIG. 1 and Korean Patent Publication No. 10-1308936, air and gas moves as shown by arrows in FIG. 1 and are mixed in an outlet. Then, the mixed air and gas is delivered to a turbo fan. However, in a structure as in FIG. 1, gas moves in a vertical direction, whereas air moves in a horizontal direction above the gas. Thus, air may prevent an inflow of gas and accordingly, gas is not actually flowed in the burner of FIG. 1.

SUMMARY OF THE INVENTION

The present invention provides a turn down ratio (TDR) damper which may efficiently deliver gas and air while controlling an amount of gas and air supplied to a burner such as a boiler or a water heater.

According to an aspect of the present invention, there is provided a turn down ratio (TDR) damper which controls an amount of gas and air flowing in the TDR damper and delivers the controlled gas and air to a turbo fan. The TDR damper may include air passages including a first air passage and a second air passage, the first air passage and the second air passage separately formed so that the air move through each path, gas passages including a first gas passage and a second gas passage, the first gas passage and the second gas passage separately formed so that the gas move through each path, and opening and closing means for opening and closing the second air passage and the second gas passage at the same time, wherein the air passages and the gas passages may be separately formed and reach outlets connected to the turbo fan so that the air and gas may be delivered to the turbo fan through a separate path.

When air flows in from the rear of the TDR damper and gas flows in from the lower part of the TDR damper so as to discharge the air and gas through the outlets disposed on the front of the TDR damper, the first air passage and the second air passage may be straight-lined pipes, the first gas passage and the second gas passage may be curved pipes, and the first air passages and the gas passages may be connected to the outlets in the same direction.

The second gas passage may include a via hole formed on one side of the curved part and the opening and closing means may include a gas opening and closing part, which opens and closes the second gas passage and an air opening and closing part, which opens and closes the second air passage. When the opening and closing means are to close the second gas passage and the second air passage, the opening and closing means may move in a direction of the outlets so that the gas opening and closing part is inserted into the via hole so as to close the second gas passage and simultaneously, the air opening and closing part close the entry of the second air passage, and when the opening and closing means are to open the second gas passage and the second air passage, the opening and closing means may move in an opposite direction of the outlets so that the gas opening and closing part opens the second gas passage and simultaneously, air opening and closing part opens the entry of the second air passage.

The air passages and the gas passages may be formed in such a way that air or gas discharged from each outlet to the turbo fan may be discharged in a same direction.

The first air passage and the second air passage may be separately formed and reach the outlets connected to the turbo fan so that the air may be delivered to the turbo fan through a separate path.

The first gas passage and the second gas passage may be separately formed and reach the outlets connected to the turbo fan so that the gas may be delivered to the turbo fan through a separate path.

According to another aspect of the present invention, there is provided a TDR damper which controls an amount of gas and air flowing in the TDR damper and delivers the controlled gas and air to a turbo fan. The TDR damper may include a first air passage and a second air passage which are separately formed so that the air move through each path, a first gas passage and a second gas passage which are separately formed so that the gas move through each path, a mixer in which the air delivered through the first air passage and the second air passage is mixed with the gas delivered through the first gas passage and the second gas passage so as to deliver the mixed air and gas to the turbo fan, and opening and closing means for opening and closing the second air passage and the second gas passage at the same time. The first air passage, the second air passage, the first gas passage, and the second gas passage may be formed so that air or gas discharged from each outlet to the mixer may be discharged in the same direction.

When air flows in from the rear of the TDR damper and gas flows in from the lower part of the TDR damper so as to mix the air and the gas in the mixer and to discharge the mixed air and gas, the first air passage and the second air passage are straight-lined pipes, the first gas passage and the second gas passage are curved pipes, and the first and second air passages and the first and second gas passages are connected to the mixer in the same direction.

The second gas passage comprises a via hole formed on one side of the curved part and the opening and closing means comprise: a gas opening and closing part, which opens and closes the second gas passage; and an air opening and closing part, which opens and closes the second air passage, wherein when the opening and closing means are to close the second gas passage and the second air passage, the opening and closing means move in a direction of the outlets so that the gas opening and closing part is inserted into the via hole so as to close the second gas passage and simultaneously, the air opening and closing part close the entry of the second air passage, and when the opening and closing means are to open the second gas passage and the second air passage, the opening and closing means move in an opposite direction of the outlets so that the gas opening and closing part opens the second gas passage and simultaneously, air opening and closing part opens the entry of the second air passage.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
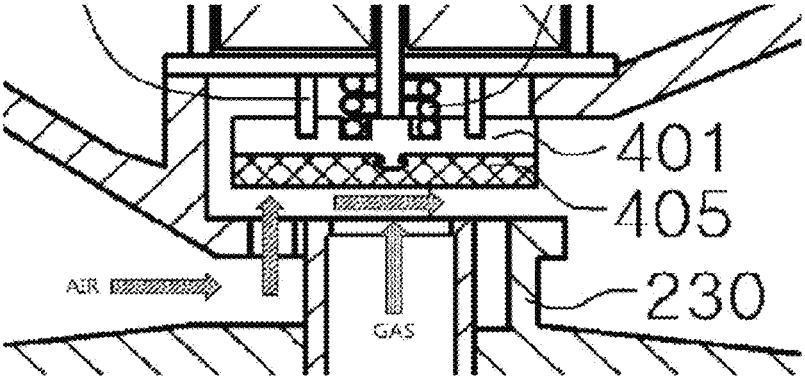
FIG. 1 illustrates moving paths of gas and air according to a prior art.

The attached drawings for illustrating exemplary embodiments of the present invention are referred to in order to gain a sufficient understanding of the present invention, the merits thereof, and the objectives accomplished by the implementation of the present invention.

Hereinafter, the present invention will be described in detail by explaining exemplary embodiments of the invention with reference to the attached drawings. Like reference numerals in the drawings denote like elements.

Figure 2:
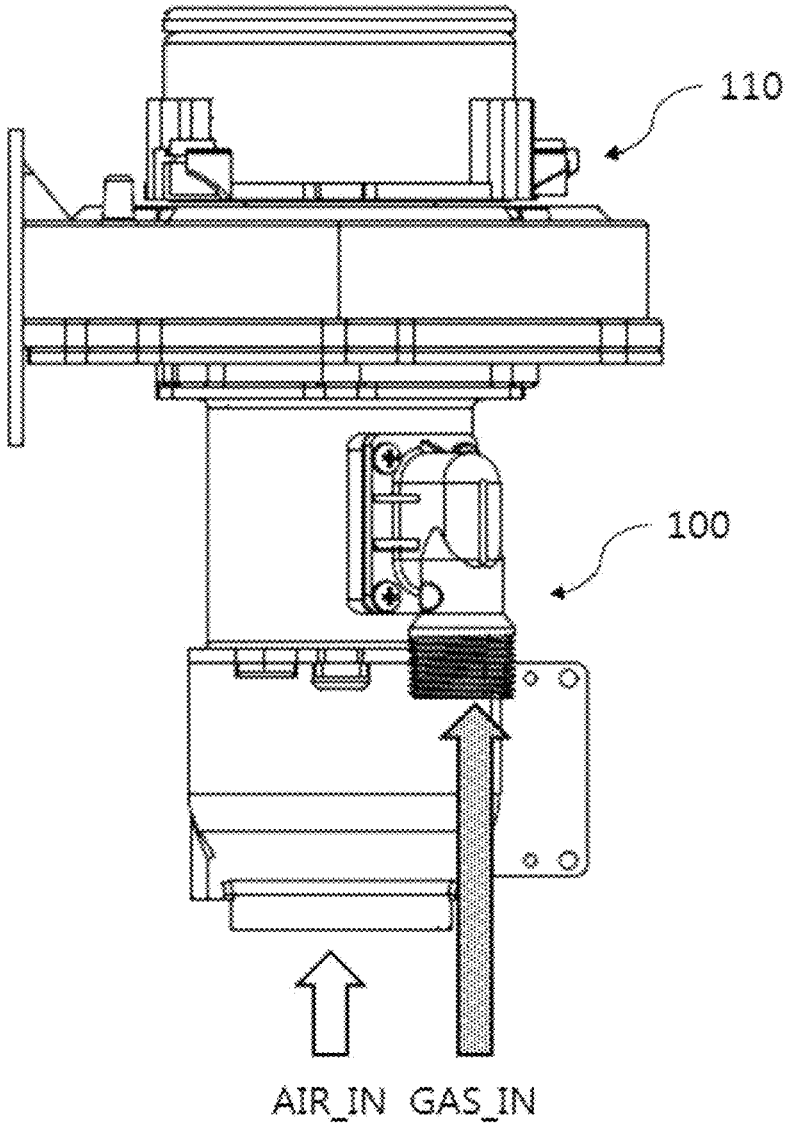
FIG. 2 illustrates a combination of a turn down ratio (TDR) damper and a turbo fan according to an embodiment of the present invention.
Figure 3:
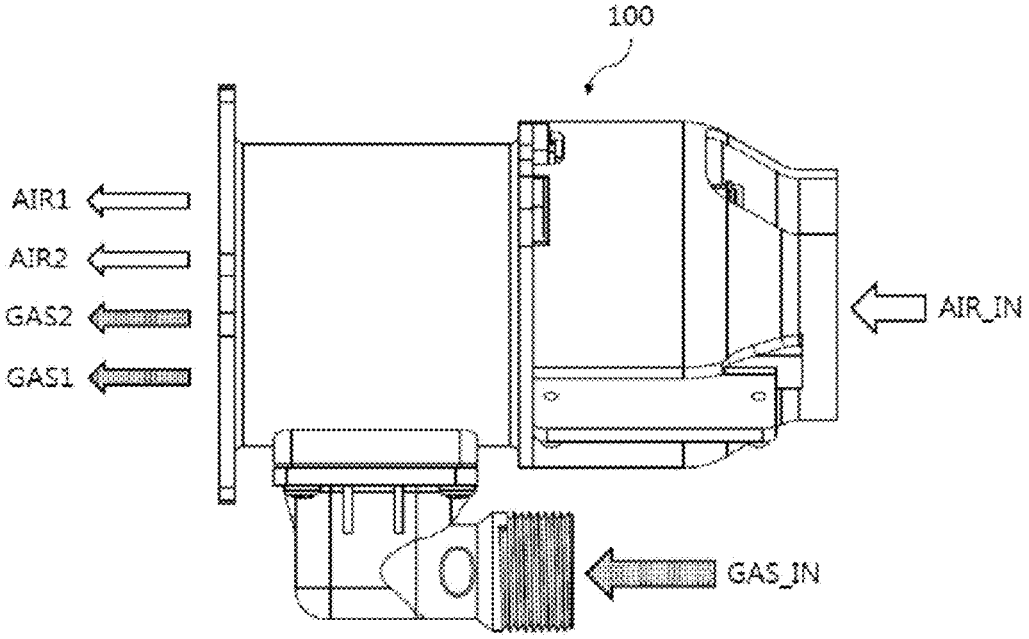
FIGS. 3 and 4 illustrate the TDR damper of FIG. 2 where air and gas are flowed therein and discharged therefrom according to an embodiment of the present invention.
Figure 4:
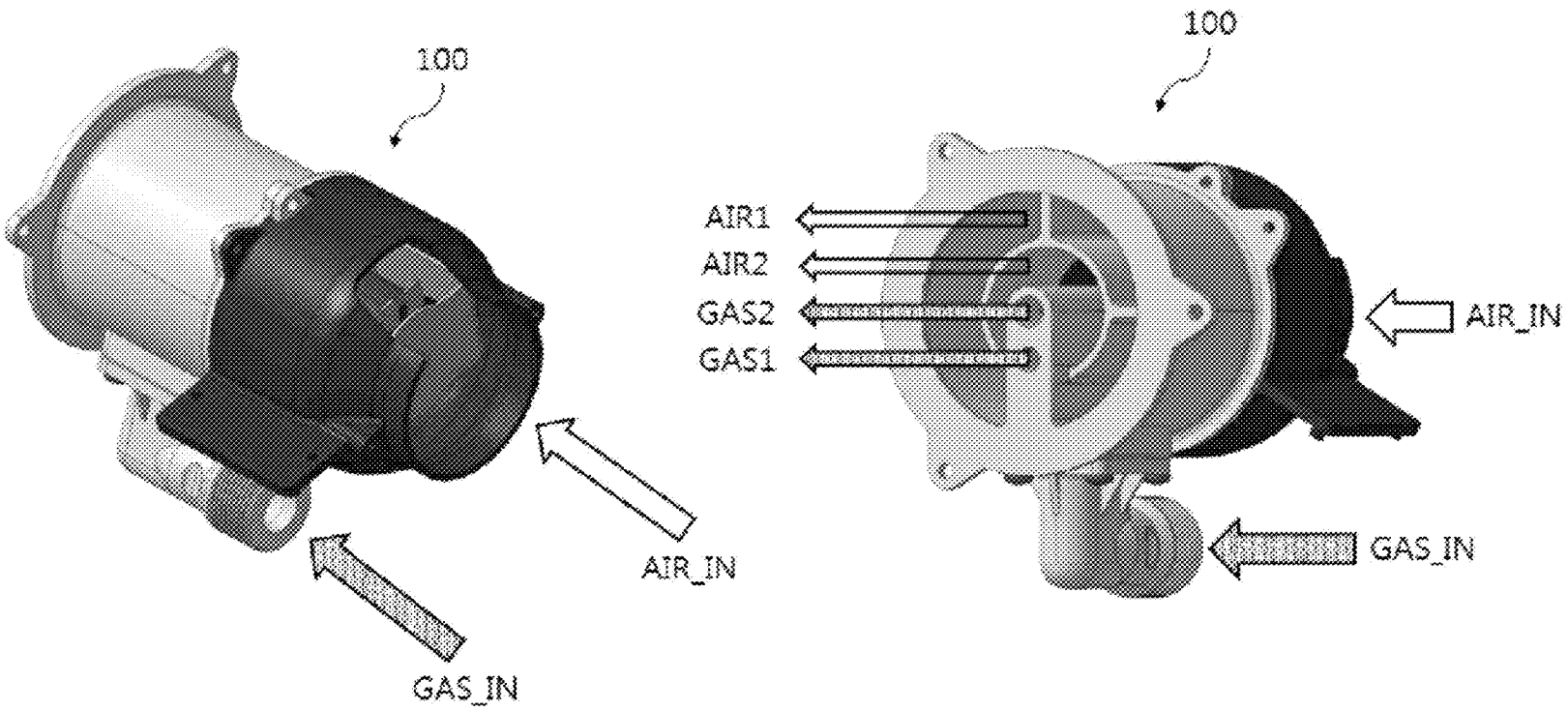

FIG. 2 illustrates a combination of a turn down ratio (TDR) damper 100 and a turbo fan 110 according to an embodiment of the present invention and FIGS. 3 and 4 illustrate the TDR damper 100 of FIG. 2 where air and gas are flowed therein and discharged therefrom.

Referring to FIGS. 2 through 4, the TDR damper 100 may control an amount of flowed air and gas and deliver the air and gas to the turbo fan 110. That is, air AIR_IN and gas GAS_IN are flowed to the TDR damper 100 and move through an air passage and a gas passage, which will be described below, so that an amount of discharged air and gas is controlled. Then, the desired amount of air AIR1 and AIR2 and gas GAS1 and GAS2 may be respectively discharged, or a desired amount of air AIR1 and AIR2 may be mixed with a desired amount of gas GAS1 and GAS2 so as to be delivered to the turbo fan 110. In FIG. 4, directions of inflows of air AIR_IN and gas GAS_IN to the TDR damper 100 and directions of discharges of air AIR1 and AIR2 and gas GAS1 and GAS2 are shown. The present invention is not limited to the TDR damper 100, however, may have various structures if an amount of air and gas may be controlled and a desired amount of air and gas may be stably delivered to the turbo fan 110. Hereinafter, various embodiments of the TDR damper 100 and operation of the TDR damper 100 will be described in more detail.

Figure 5:
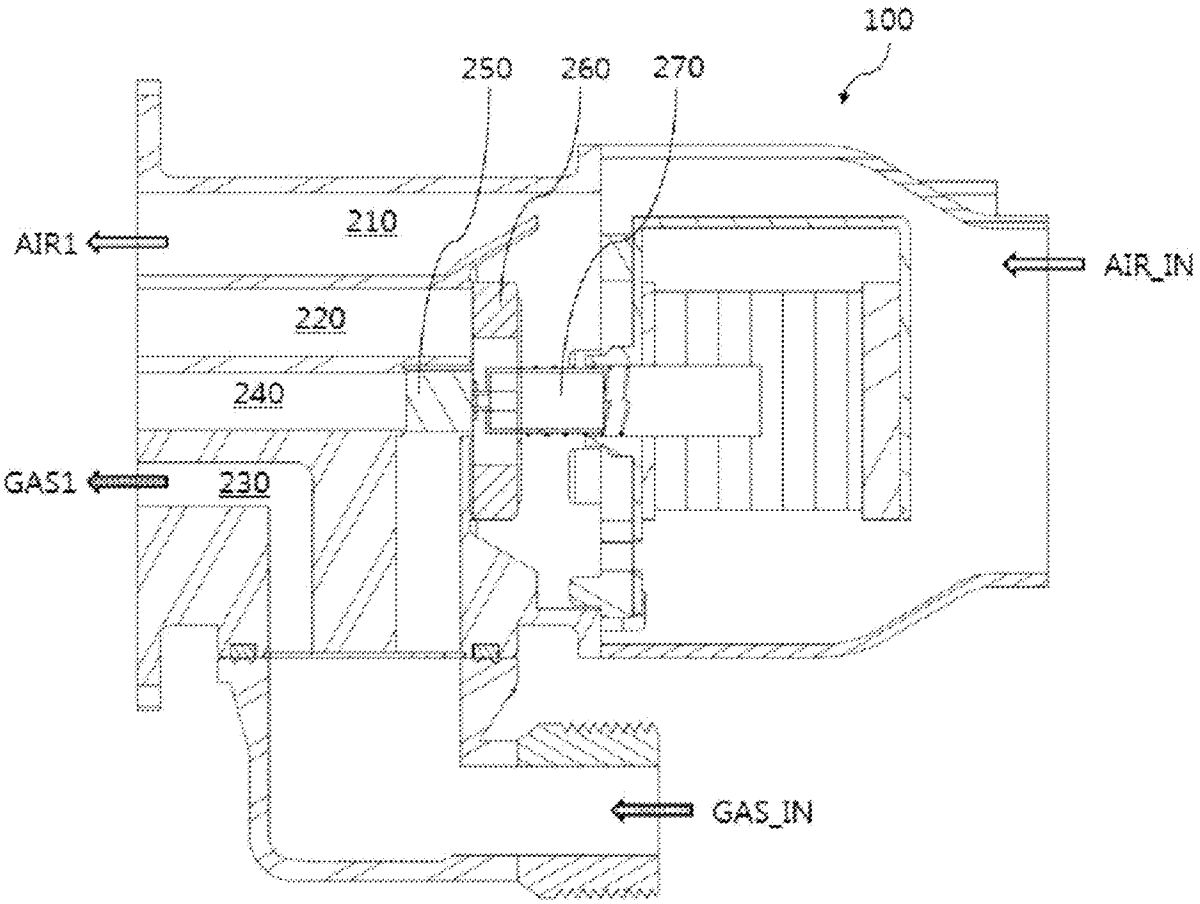
FIGS. 5 and 6 respectively illustrate an inner structure of the TDR damper of FIG. 1 according to an embodiment of the present invention.
Figure 6:
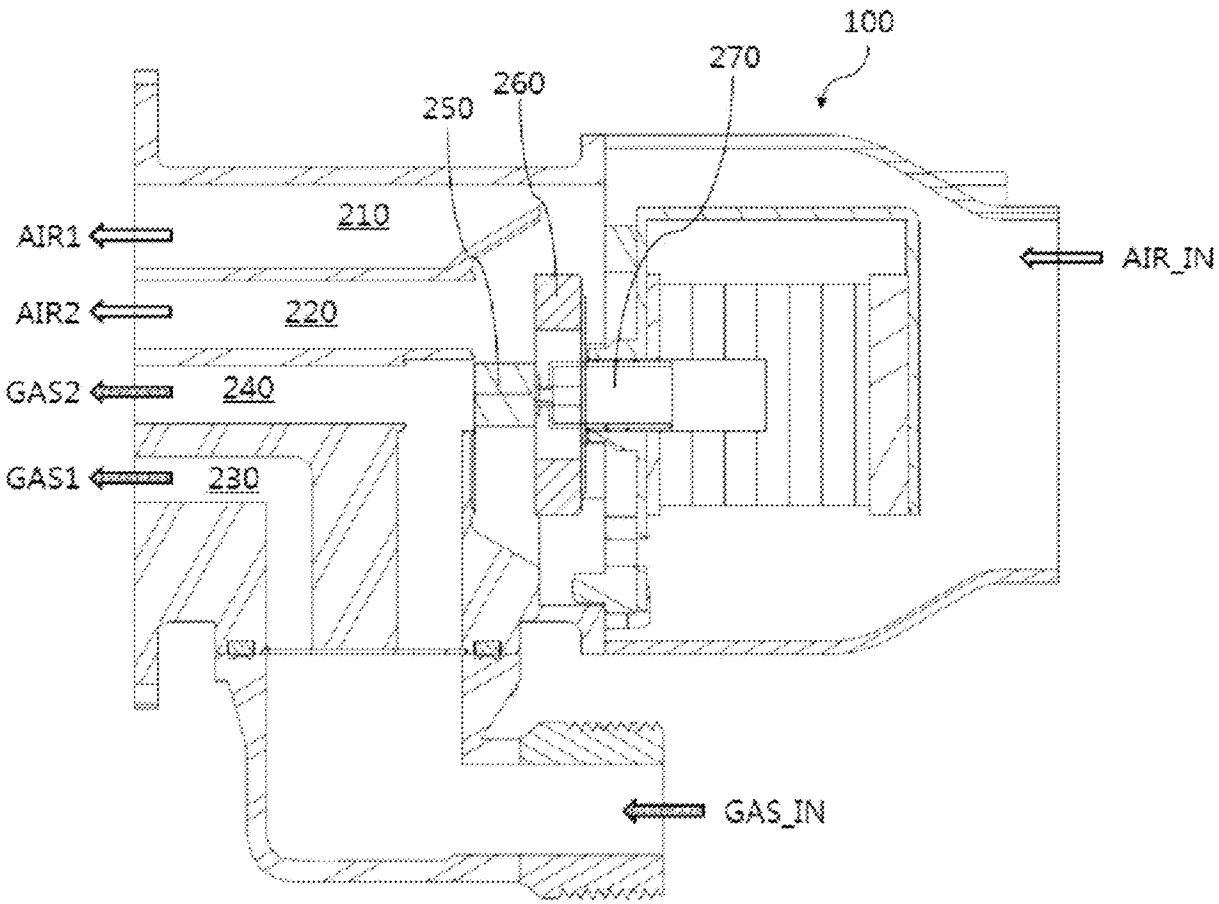

FIGS. 5 and 6 respectively illustrate an inner structure of the TDR damper 100 of FIG. 1 according to an embodiment of the present invention.

Referring to FIGS. 1 through 6, the TDR damper 100 may include first and second air passages 210 and 220, first and second gas passages 230 and 240, and opening and closing means 250 and 260. The first and second air passages 210 and 220 provide paths through which air AIR_IN is flowed and is delivered to the turbo fan 110 through an outlet and may be divided into the first air passage 210 and the second air passage 220. That is, the first air passage 210 and the second air passage 220 may be separated from each other so that the flowed air AIR_IN may move through the respective passages. In addition, the first and second gas passages 230 and 240 provide paths through which gas GAS_IN is flowed and is delivered to the turbo fan 110 through an outlet and may be divided into the first gas passage 230 and the second gas passage 240. That is, the first gas passage 230 and the second gas passage 240 may be separated from each other so that the flowed gas GAS_IN may move through the respective passages.

The opening and closing means 250 may open or close the second air passage 220 and the second gas passage 240 at the same time. For example, in a first mode for burning air and gas to a minimum as shown in FIG. 5, the opening and closing means 250 closes the second air passage 220 and the second gas passage 240 at the same time. Accordingly, the air AIR_IN moves only through the first air passage 210 and the gas GAS_IN moves only through the first gas passage 230. On the other hand, in a second mode for burning air and gas to a maximum as shown in FIG. 6, the opening and closing means 250 opens the second air passage 220 and the second gas passage 240 at the same time. Accordingly, the air AIR_IN moves through the first air passage 210 and the second air passage 220, and the gas GAS_IN moves through the first gas passage 230 and the second gas passage 240.

Moving paths of gas and air in each mode will be described in more detail with reference to FIGS. 7 and 8.

The first and second air passages 210 and 220 and the first and second gas passages 230 and 240 may be separately formed and reached the outlets (parts where the air AIR1 and AIR2 and the gas GAS1 and GAS2 are discharged in FIGS. 5 and 6) connected to the turbo fan 110 so that the air AIR_IN and the gas GAS_IN may be delivered to the turbo fan 110 through a separate path. That is, the first and second air passages 210 and 220, through which air moves, and the first and second gas passages 230 and 240, through which gas moves, are separated from each other until reaching the outlets. Thus, gas and air may be prevented from being abnormally delivered due to a flow of air and a flow of gas, respectively. Accordingly, a desired amount of air and gas may be stably delivered to the turbo fan 110.

In addition, the first and second air passages 210 and 220 and the first and second gas passages 230 and 240 may be formed in such a way that air or gas discharged from each outlet to the turbo fan 110 may be discharged in a same direction. That is, as illustrated in FIGS. 5 and 6, parts connected to the outlets of the first and second air passages 210 and 220 and the first and second gas passages 230 and 240 are parallel to each other in a same direction. Accordingly, the air AIR1 and AIR2 and the gas GAS1 and GAS2 may all be discharged in a same direction and delivered to the turbo fan 110. Therefore, the gas GAS1 and GAS2 may be prevented from being abnormally delivered due to a flow of the air AIR1 and AIR2, and the air AIR1 and AIR2 may be prevented from being abnormally delivered due to a flow of the gas GAS1 and GAS2. Accordingly, a desired amount of air and gas may be stably delivered to the turbo fan 110.

The first air passage 210 and the second air passage 220 may be separately formed and reached the outlets connected to the turbo fan 110 so that the air AIR_IN may be delivered to the turbo fan 110 through a separate path. Also, the first gas passage 230 and the second gas passage 240 may be separately formed and reached the outlets connected to the turbo fan 110 so that the gas GAS_IN may be delivered to the turbo fan 110 through a separate path. However, in the TDR damper 100 according to an embodiment of the present invention, the first and second air passages 210 and 220 and the first and second gas passages 230 and 240 are separated from each other until reaching the outlets. Accordingly, the first air passage 210 may be joined to the second air passage 220 near the outlets of the TDR damper 100, or the first gas passage 230 may be joined to the second gas passage 240 near the outlets of the TDR damper 100.

A join of the first air passage 210 and the second air passage 220 near the outlets of the TDR damper 100 will be described in more detail with reference to FIGS. 9 through 12.

When the air AIR_IN flows in from the rear of the TDR damper 100 and the gas GAS_IN flows in from the lower part of the TDR damper 100 so as to discharge the air and gas through the outlets disposed on the front of the TDR damper 100, the first air passage 210 and the second air passage 220 may be straight-lined pipes formed from the rear of the TDR damper 100 to the front of the TDR damper 100, and the first gas passage 230 and the second gas passage 240 may be pipes curved from the lower part of the TDR damper 100 to the front of the TDR damper 100. The first and second air passages 210 and 220 and the first and second gas passages 230 and 240 may be connected to the outlets in the same direction. As such, when the first and second air passages 210 and 220 and the first and second gas passages 230 and 240 are formed, a via hole may be formed on one side of the curved part of the second gas passage 240.

The opening and closing means 250 and 260 may be a gas opening and closing part 250, which opens and closes the second gas passage 240, and an air opening and closing part 260, which opens and closes the second air passage 220. Such opening and closing means 250 and 260 may move in the front direction or the rear direction of the TDR damper 100 by using a valve 270. The valve 270 may be a solenoid valve. When the second gas passage 240 and the second air passage 220 are to be closed, the opening and closing means 250 and 260 move in a direction of the outlets (a direction to the front of the TDR damper 100) so that the gas opening and closing part 250 is inserted into the via hole so as to close the second gas passage 240. Simultaneously, the air opening and closing part 260 may close the entry of the second air passage 220. In addition, when the second gas passage 240 and the second air passage 220 are to be open, the opening and closing means 250 and 260 move in an opposite direction of the outlets (a direction to the rear of the TDR damper 100) so that the gas opening and closing part 250 opens the second gas passage 240. Simultaneously, air opening and closing part 260 may open the entry of the second air passage 220. That is, the opening and closing means 250 and 260 according to the embodiment of the present invention move so that the second air passage 220 and the second gas passage 240 may be simultaneously opened and closed. Thus, the opening and closing means 250 and 260 may be operated in the first mode or the second mode, wherein the first mode is to burn air and gas to a minimum and the second mode is to burn air and gas to a maximum. The present invention is not limited to the first and second air passages 210 and 220, the first and second gas passages 230 and 240, and the opening and closing means 250 and 260 illustrated above, however, may have various structures if air and gas may be discharged as described above.

Figure 7:
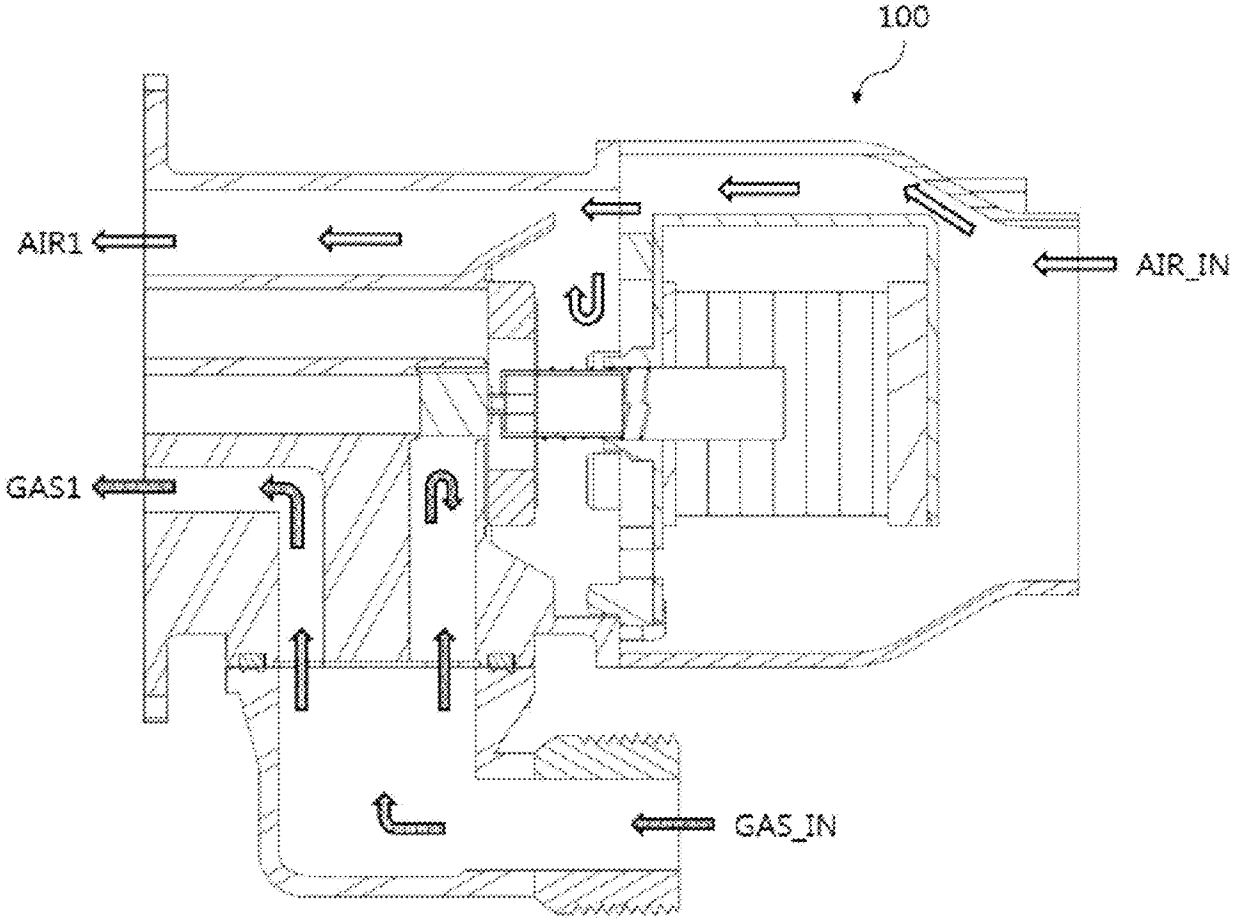
FIG. 7 illustrates moving paths of gas and air in the TDR damper of FIG. 5.
Figure 8:
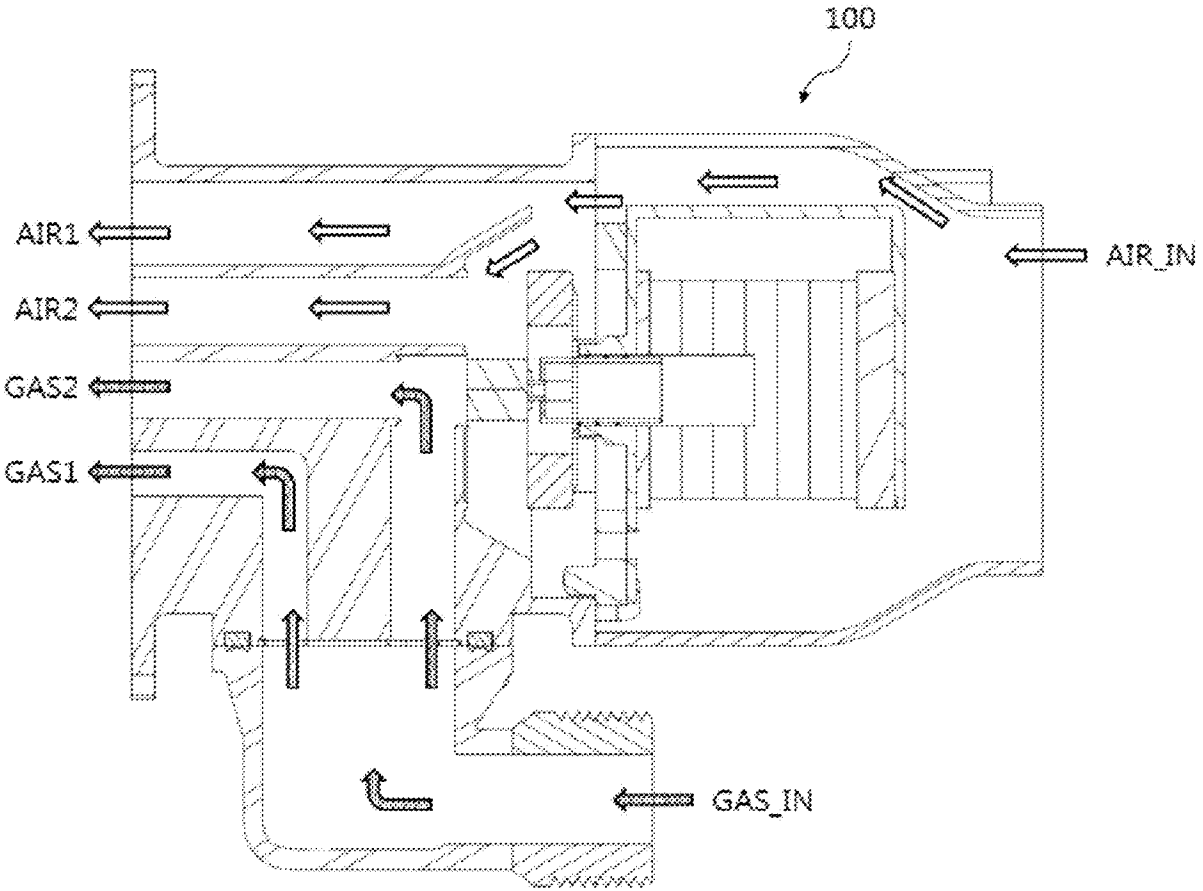
FIG. 8 illustrates moving paths of gas and air in the TDR damper of FIG. 6.

FIG. 7 illustrates moving paths of gas and air in the TDR damper 100 of FIG. 5 and FIG. 8 illustrates moving paths of gas and air in the TDR damper 100 of FIG. 6.

Hereinafter, moving paths of air and gas in the first mode and the second mode will be described with reference to FIGS. 1 through 8. Firstly, in the first mode for burning air and gas to a minimum, the second air passage 220 and the second gas passage 240 are closed by the opening and closing means 250 and 260 so that the air AIR_IN is discharged to the turbo fan 110 only through the outlet of the first air passage 210 as shown in FIG. 7 and the gas GAS_IN is discharged to the turbo fan 110 only through the outlet of the first gas passage 230 as shown in FIG. 7.

Next, in the second mode for burning air and gas to a maximum, the second air passage 220 and the second gas passage 240 are opened by the opening and closing means 250 and 260 so that the air AIR_IN is discharged to the turbo fan 110 through the outlets of the first air passage 210 and the second air passage 220 as shown in FIG. 8 and the gas GAS_IN is discharged to the turbo fan 110 through the outlets of the first gas passage 230 and the second gas passage 240 as shown in FIG. 8.

In both the first mode and the second mode, air and gas are discharged to the turbo fan and are mixed in the turbo fan. The mixture is delivered through each separate path and is discharged through the outlets in the same direction. Thus, when the TDR damper 100 according to an embodiment of the present invention is used, each moving path may be prevented from being disturbed by interference occurring while delivering and discharging air and gas.

Figure 9:
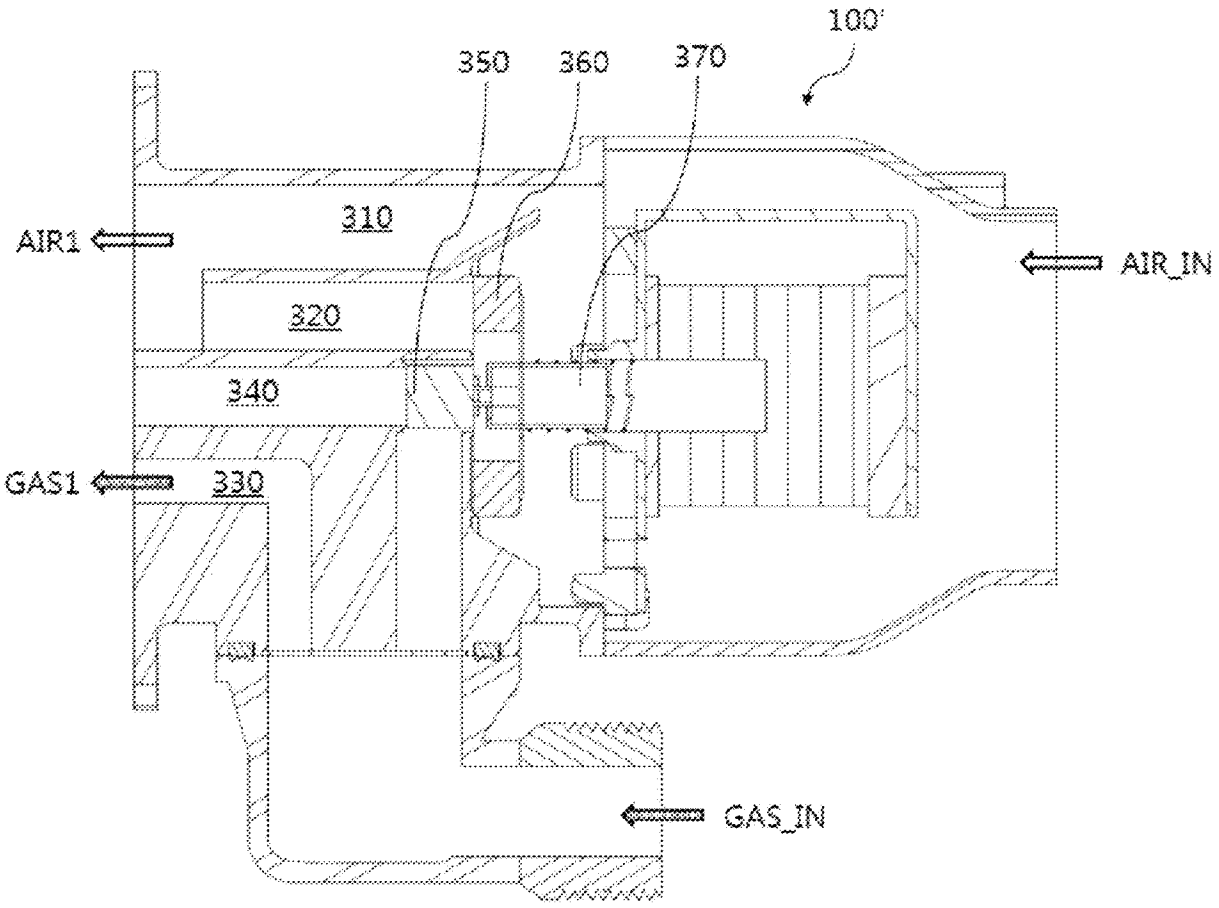
FIGS. 9 and 10 respectively illustrate an inner structure of a TDR damper according to another embodiment of the present invention.
Figure 10:
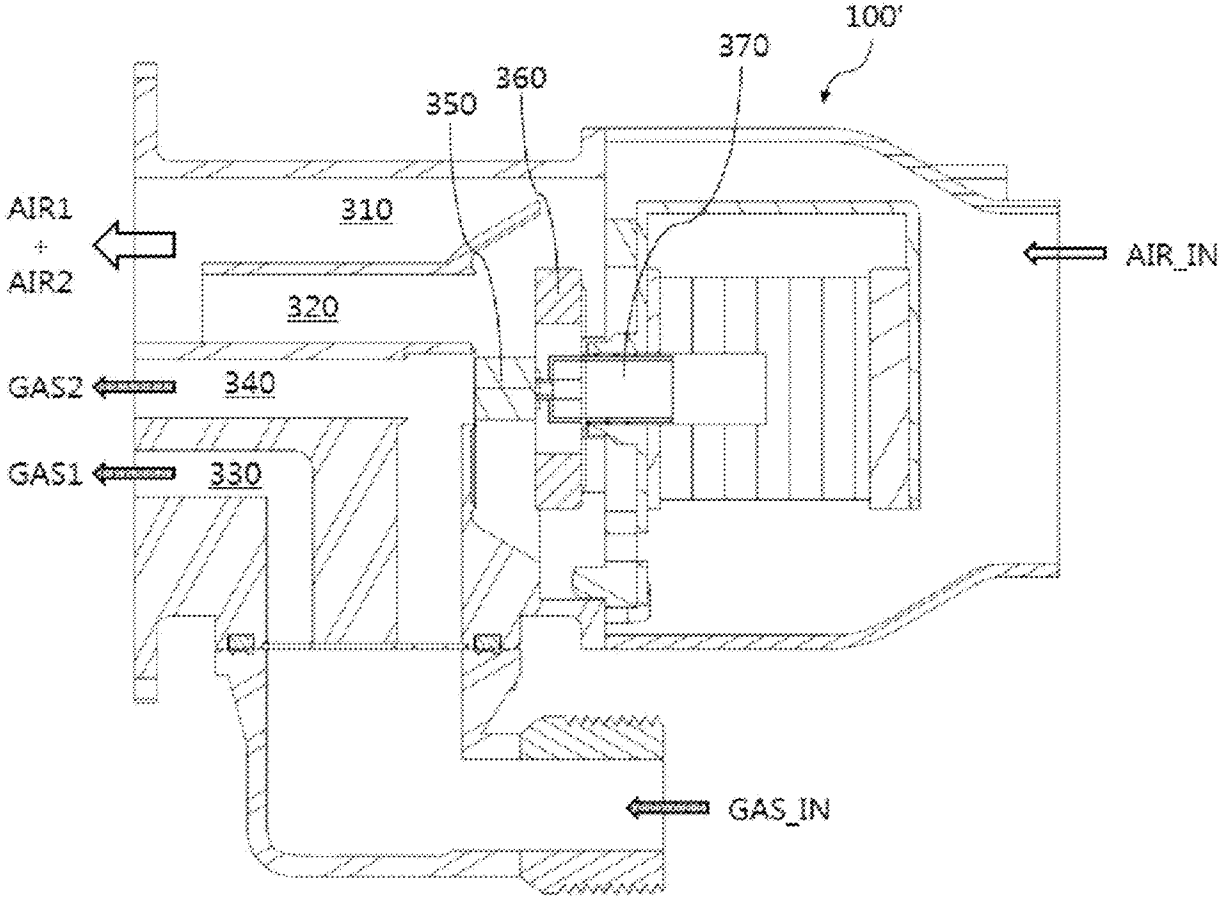
Figure 11:
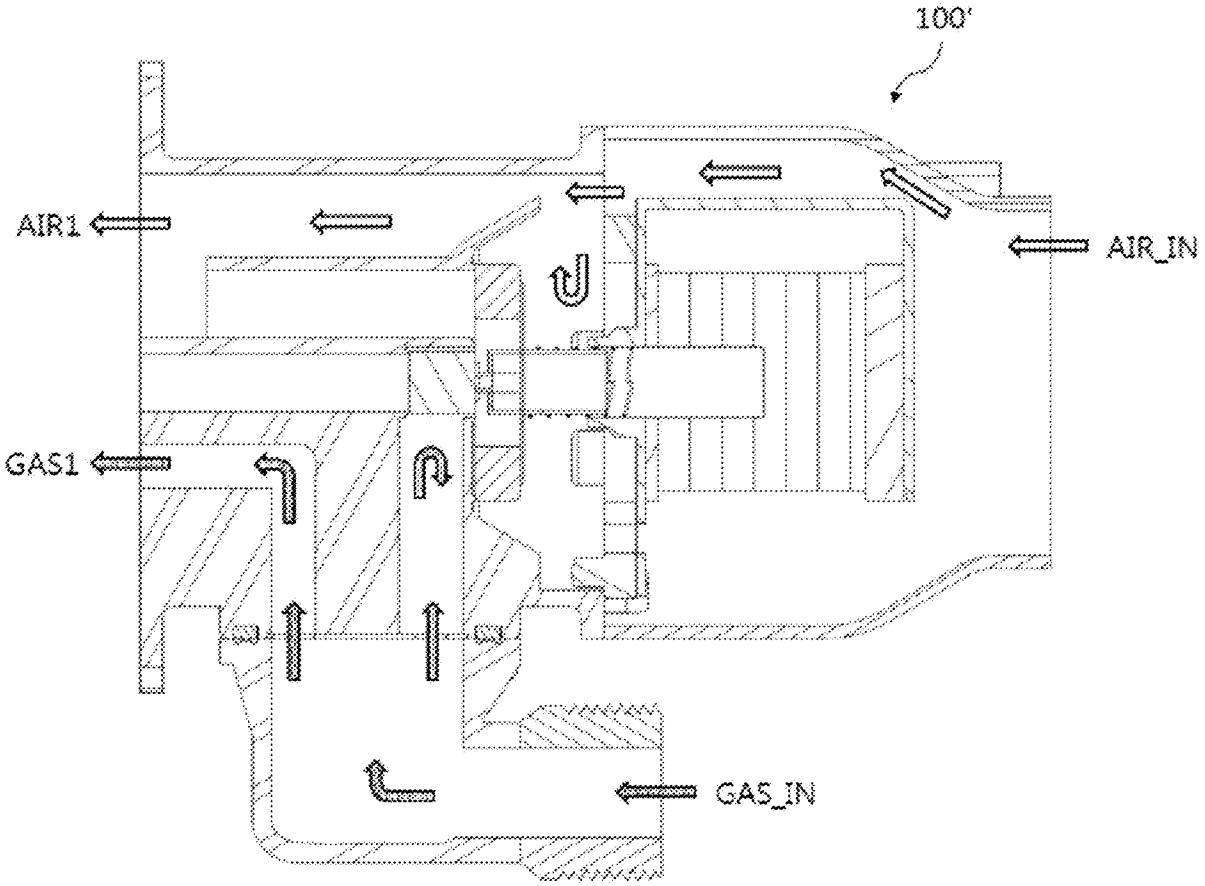
FIG. 11 illustrates moving paths of gas and air in the TDR damper of FIG. 9.
Figure 12:
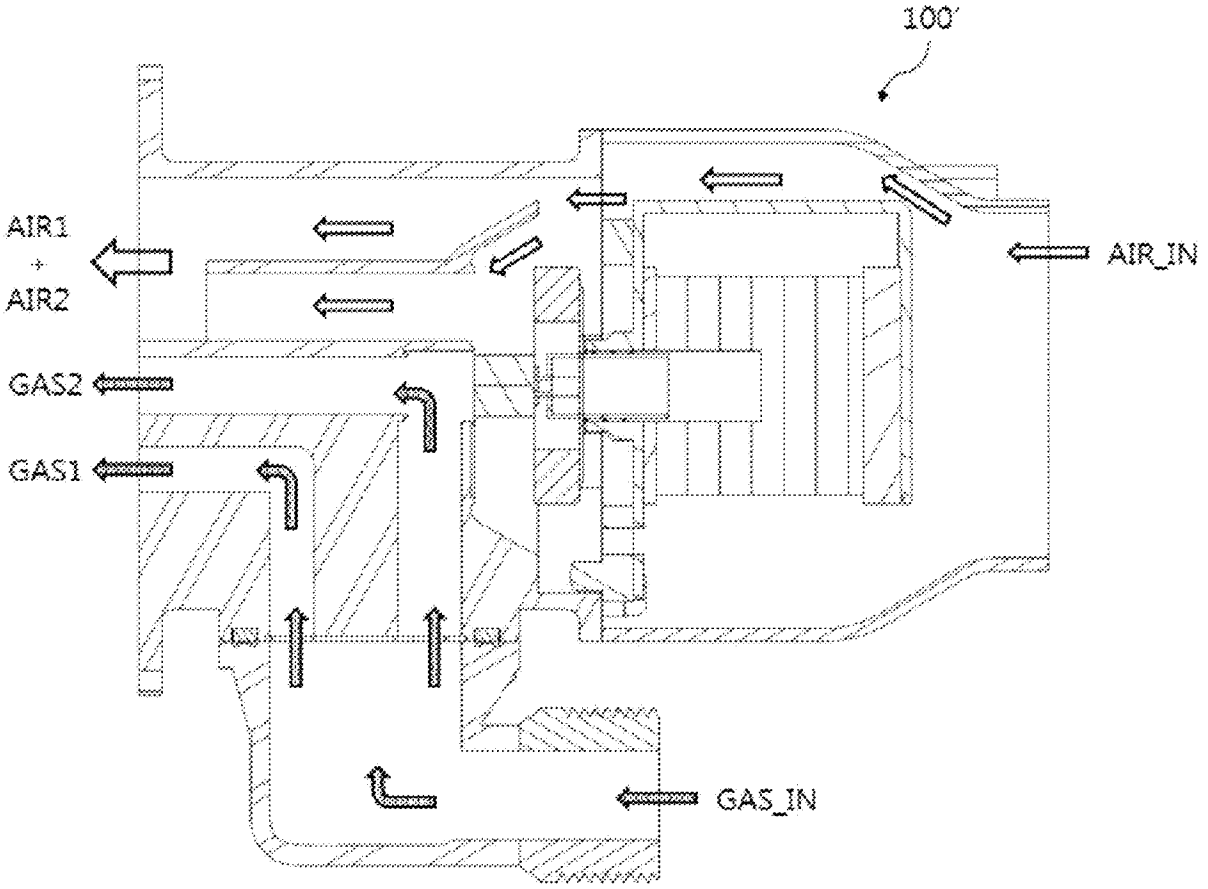
FIG. 12 illustrates moving paths of gas and air in the TDR damper of FIG. 10.

FIGS. 9 and 10 respectively illustrate an inner structure of a TDR damper 100' according to another embodiment of the present invention, FIG. 11 illustrates moving paths of gas and air in the TDR damper 100' of FIG. 9 and FIG. 12 illustrates moving paths of gas and air in the TDR damper 100' of FIG. 10

Referring to FIGS. 1 through 12, the TDR damper 100' may include first and second air passages 310 and 320, first and second gas passages 330 and 340, and opening and closing means 350 and 360. The TDR damper 100' is the same as the TDR damper 100 illustrated with reference to FIGS. 5 through 8 except for the outlets of the first and second air passages 310 and 320. Thus, the description of the TDR damper 100' may be referred to that of the TDR damper 100 described with reference to FIGS. 5 through 8 and only the difference will be described below.

In FIGS. 9 and 10, the first air passage 310 and the second air passage 320 are not separated from each other until the air outlets of the TDR damper 100' and are combined together just before the air outlets of the TDR damper 100'. Even if the first air passage 310 and the second air passage 320 are combined together at the front of the air outlets of the TDR damper 100', the TDR damper 100' is operated as described above with reference to FIGS. 5 through 8. That is, the second mode in FIGS. 10 and 12 is operated the same as in FIGS. 5 through 8 except that air AIR1 discharged through the first air passage 310 is mixed with air AIR2 discharged through the second air passage 320 in the air outlet of the TDR damper 100' and the mixed air is discharged through the air outlet of the TDR damper 100'.

Although not illustrated in drawings, in the TDR damper 100', the first gas passage 330 and the second gas passage 340 may not be separated from each other until the gas outlets of the TDR damper 100' and are combined together just before the gas outlets of the TDR damper 100'. Also, the TDR damper 100' may include the first air passage 310 and the second air passage 320 which combined together just before the air outlets of the TDR damper 100' and may include the first gas passage 330 and the second gas passage 340 which are combined together just before the gas outlets of the TDR damper 100'. In all embodiments described above, the air passages and the gas passages are respectively separated from each other until each outlet of the TDR damper and thus air and gas may be delivered in the same manner as in FIGS. 5 through 8, thereby showing the same effect.

Figure 13:
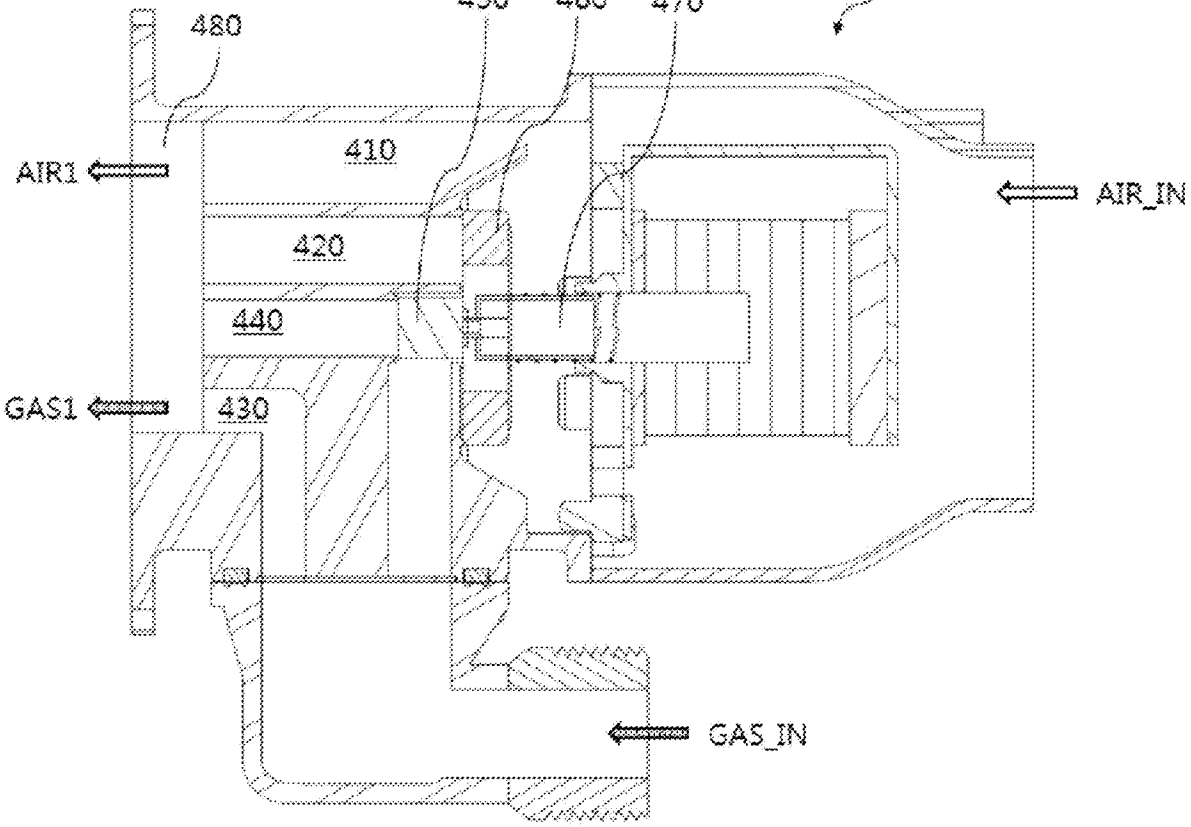
FIGS. 13 and 14 respectively illustrate an inner structure of a TDR damper according to another embodiment of the present invention.
Figure 14:
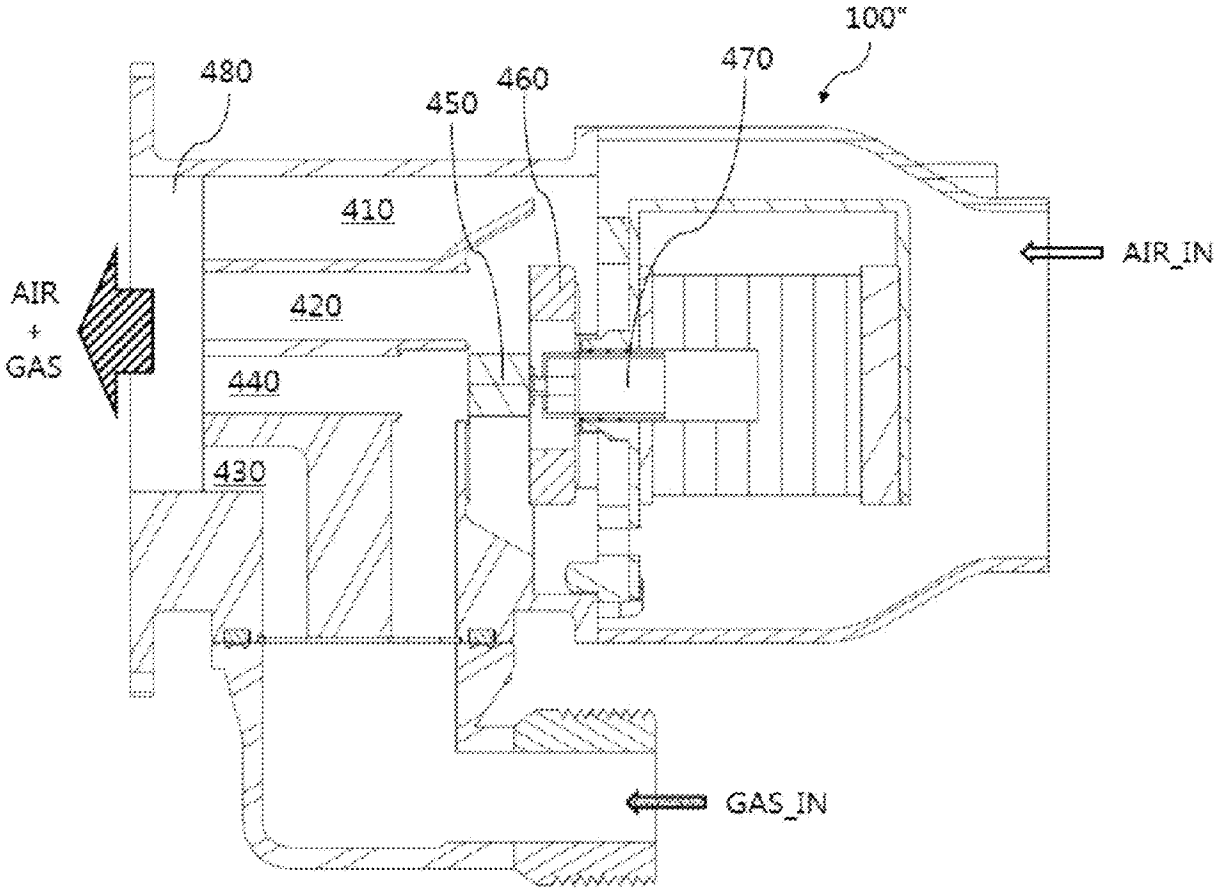
Figure 15:
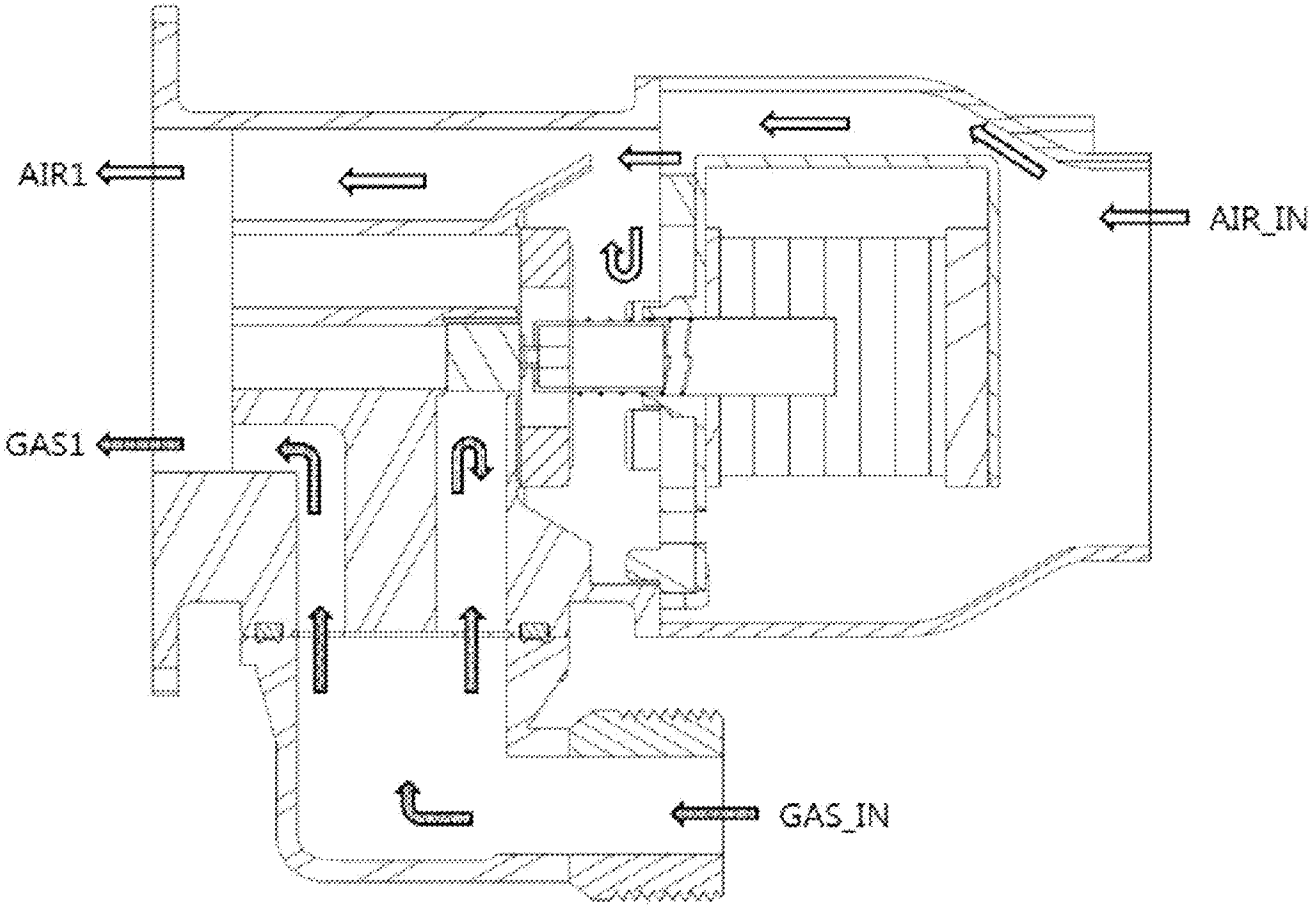
FIG. 15 illustrates moving paths of gas and air in the TDR damper of FIG. 13.
Figure 16:
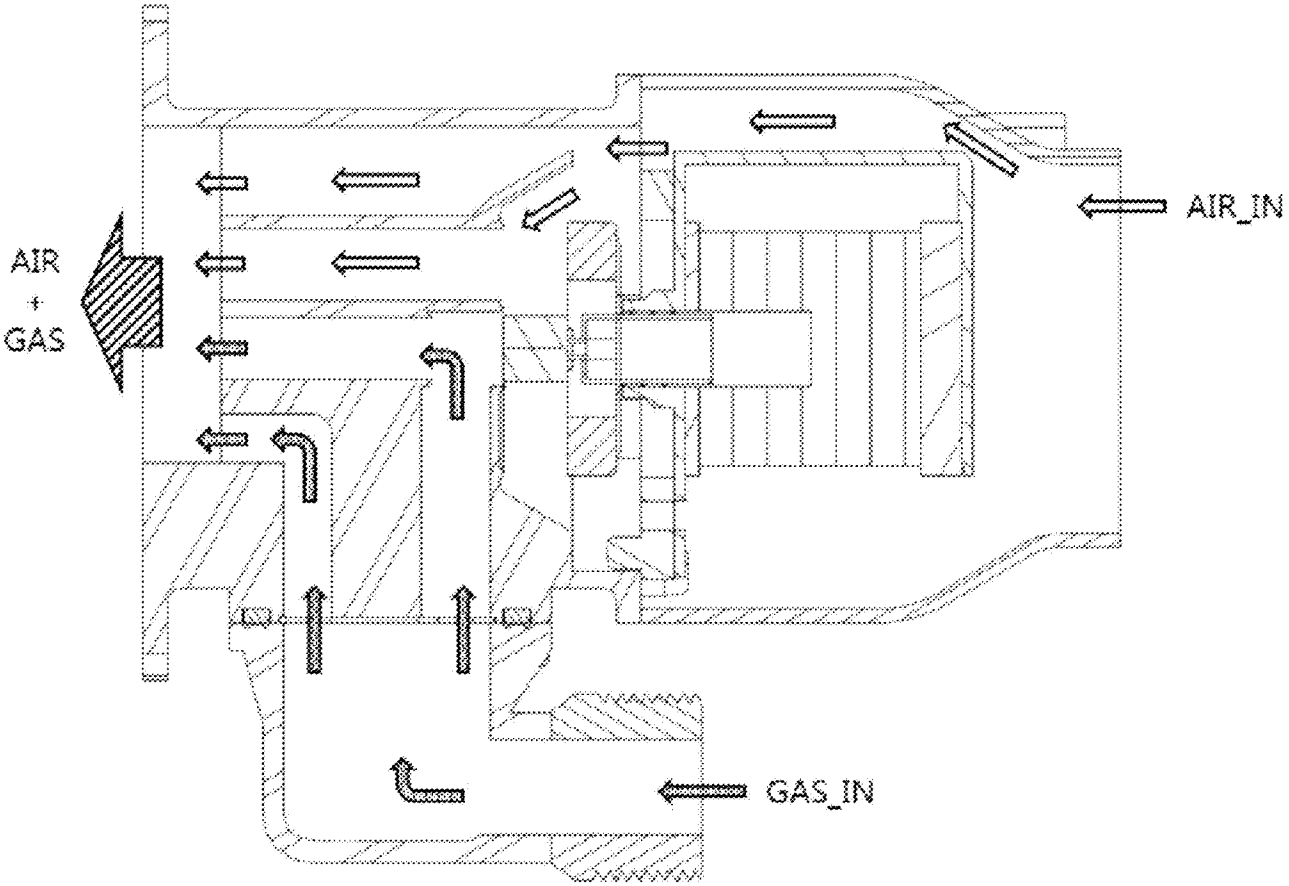
FIG. 16 illustrates moving paths of gas and air in the TDR damper of FIG. 14.

FIGS. 13 and 14 respectively illustrate an inner structure of a TDR damper 100" according to another embodiment of the present invention, FIG. 15 illustrates moving paths of gas and air in the TDR damper 100" of FIG. 13, and FIG. 16 illustrates moving paths of gas and air in the TDR damper 100" of FIG. 14.

Referring to FIGS. 1 through 16, the TDR damper 100" may include first and second air passages 410 and 420, first and second gas passages 430 and 440, a mixer 480, and opening and closing means 450 and 460. The structure and operation of the TDR damper 100" is the same as the TDR damper 100 described with reference to FIGS. 5 through 8 except that the TDR damper 100" further includes the mixer 480. Thus, the description of the TDR damper 100" may be referred to that of the TDR damper 100 described with reference to FIGS. 5 through 8 and only the difference will be described below.

In the TDR damper 100" of FIGS. 13 through 16, the outlets of the first and second air passages 410 and 420 and the first and second gas passages 430 and 440 are not directly connected to the turbo fan 110 and instead, are connected to the mixer 480. Accordingly, air and gas may be mixed together in the mixer 480 and air and gas AIR+GAS may be discharged to the turbo fan 110. As such, if the mixer 480 is formed in the outlet of the TDR damper 100", the first air passage 410, the second air passage 420, the first gas passage 430, and the second gas passage 440 may be formed so that air or gas discharged from each outlet to the mixer 480 may be discharged in the same direction. Accordingly, in FIGS. 13 through 16, air and gas are also delivered through each separate path and are discharged from the outlets of the first and second air passages 410 and 420 and the first and second gas passages 430 and 440 to the mixer 480 in the same direction. Therefore, when the TDR damper 100" according to an embodiment of the present invention is used, each moving path may be prevented from being disturbed by interference occurring while delivering and discharging air and gas.

The first air passage 410 and the second air passage 420 may be separated from each other until reaching the outlets connected to the mixer 480 so that the air AIR_IN may move to the mixer 480 through each path. Also, the first gas passage 430 and the second gas passage 440 may be separated from each other until reaching the outlets connected to the mixer 480 so that the gas GAS_IN may move to the mixer 480 through each path. When the first and second air passages 410 and 420 and the first and second gas passages 430 and 440 are separated from each other until reaching the outlets connected to the mixer 480, the first air passage 410 and the second air passage 420 may be combined together near the outlets thereof and the first gas passage 430 and the second gas passage 440 may be combined together near the outlets thereof.

When the air AIR_IN flows in from the rear of the TDR damper 100" and the gas GAS_IN flows in from the lower part of the TDR damper 100" so as to mix the air and the gas in the mixer 480 disposed at the front of the TDR damper 100" and to discharge the mixed air and gas, the first air passage 410 and the second air passage 420 may be straight-lined pipes formed from the rear of the TDR damper 100" to the front of the TDR damper 100", and the first gas passage 430 and the second gas passage 440 may be pipes curved from the lower part of the TDR damper 100" to the front of the TDR damper 100". The first and second air passages 410 and 420 and the first and second gas passages 430 and 440 may be connected to the outlets in the same direction. As such, when the first and second air passages 410 and 420 and the first and second gas passages 430 and 440 are formed, a via hole may be formed on one side of the curved part of the second gas passage 440.

In addition, the opening and closing means 450 and 460 may be a gas opening and closing part 450, which opens and closes the second gas passage 440, and an air opening and closing part 460, which opens and closes the second air passage 420. Such opening and closing means 450 and 460 may move in the front direction or the rear direction of the TDR damper 100" by using a valve 470. The valve 470 may be a solenoid valve. When the second gas passage 440 and the second air passage 420 are to be closed, the opening and closing means 450 and 460 move in a direction of the outlets (a direction to the front of the TDR damper 100") so that the gas opening and closing part 450 is inserted into the via hole so as to close the second gas passage 440. Simultaneously, the air opening and closing part 460 may close the entry of the second air passage 420. In addition, when the second gas passage 440 and the second air passage 420 are to be open, the opening and closing means 450 and 460 move in an opposite direction of the outlets (a direction to the rear of the TDR damper 100") so that the gas opening and closing part 450 opens the second gas passage 440. Simultaneously, air opening and closing part 460 may open the entry of the second air passage 420. That is, the opening and closing means 450 and 460 according to the embodiment of the present invention move so that the second air passage 420 and the second gas passage 440 may be simultaneously opened and closed. Thus, the opening and closing means 450 and 460 may be operated in the first mode or the second mode, wherein the first mode is to burn air and gas to a minimum and the second mode is to burn air and gas to a maximum. The present invention is not limited to the first and second air passages 410 and 420, the first and second gas passages 430 and 440, and the opening and closing means 450 and 460 illustrated above, however, may have various structures if air and gas may be discharged as described above.

In the TDR damper according to the embodiments of the present invention, air and gas is directly flowed to the turbo fan through each different path and air and gas are discharged in the same direction. Thus, a flow of gas may be prevented while air moves, thereby increasing TDR. Also, as the TDR increases, an amount of gas and air needed in burners may be controlled in a wider range than that of in the existing TDR damper. Accordingly, a minute heating control may be available while in flow variation and a range of changes in temperature of hot water may be decreased.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A turn down ratio (TDR) damper which controls an amount of gas and air flowing in the TDR damper and delivers the controlled gas and air to a turbo fan, the TDR damper comprising:

air passages comprising a first air passage and a second air passage, the first air passage and the second air passage separately formed so that the air moves through each path;

gas passages comprising a first gas passage and a second gas passage, the first gas passage and the second gas passage separately formed so that the gas moves through each path; and opening and closing means for opening and closing the second air passage and the second gas passage at the same time, wherein the air passages and the gas passages are separately formed and reached outlets connected to the turbo fan so that the air and gas are allowed to be delivered to the turbo fan through a separate path, wherein when air flows in from the rear of the TDR damper and gas flows in from the lower part of the TDR damper so as to discharge the air and gas through the outlets disposed on the front of the TDR damper, the first air passage and the second air passage comprise straight-lined pipes and the first gas passage and the second gas passage comprise curved pipes, the first air passages and the gas passages connected to the outlets in the same direction, wherein the second gas passage comprises a via hole formed on one side of the curved part and the opening and closing means comprises: a gas opening and closing part, which opens and closes the second gas passage; and an air opening and closing part, which opens and closes the second air passage, wherein the opening and closing means closes the second gas passage and the second air passage by the opening and closing moving in a direction of the outlets so that the gas opening and closing part is inserted into the via hole so as to close the second gas passage and simultaneously, the air opening and closing part close the entry of the second air passage, and when the opening and closing means are to open the second gas passage and the second air passage, the opening and closing means move in an opposite direction of the outlets so that the gas opening and closing part opens the second gas passage and simultaneously, air opening and closing part opens the entry of the second air passage.

2. The TDR damper of claim 1, wherein the air passages and the gas passages are formed in such a way that air or gas discharged from each outlet to the turbo fan are discharged in a same direction.

3. The TDR damper of claim 1, wherein the first air passage and the second air passage are separately formed and reached the outlets connected to the turbo fan so that the air is delivered to the turbo fan through separate paths.

4. The TDR damper of claim 1, wherein the first gas passage and the second gas passage are separately formed and reached the outlets connected to the turbo fan so that the gas is delivered to the turbo fan through separate paths.

5. A turn down ratio (TDR) damper which controls an amount of gas and air flowing in the TDR damper and delivers the controlled gas and air to a turbo fan, the TDR damper comprising:

a first air passage and a second air passage which are separately formed so that the air moves through each path;

a first gas passage and a second gas passage which are separately formed so that the gas moves through each path;

a mixer in which the air delivered through the first air passage and the second air passage is mixed with the gas delivered through the first gas passage and the second gas passage so as to deliver the mixed air and gas to the turbo fan; and opening and closing means for opening and closing the second air passage and the second gas passage at the same time, wherein the first air passage, the second air passage, the first gas passage, and the second gas passage are formed so that air or gas discharged from each outlet to the mixer may be discharged in the same direction, wherein when air flows in from the rear of the TDR damper and gas flows in from the lower part of the TDR damper so as to mix the air and the gas in the mixer and to discharge the mixed air and gas, the first air passage and the second air passage are straight-lined pipes, the first gas passage and the second gas passage are curved pipes, and the first and second air passages and the first and second gas passages are connected to the mixer in the same direction, wherein the second gas passage comprises a via hole formed on one side of the curved part and the opening and closing means comprises: a gas opening and closing part, which opens and closes the second gas passage; and an air opening and closing part, which opens and closes the second air passage, wherein the opening and closing means closes the second gas passage and the second air passage by the opening and closing moving in a direction of the outlets so that the gas opening and closing part is inserted into the via hole so as to close the second gas passage and simultaneously, the air opening and closing part close the entry of the second air passage, and when the opening and closing means are to open the second gas passage and the second air passage, the opening and closing means move in an opposite direction of the outlets so that the gas opening and closing part opens the second gas passage and simultaneously, air opening and closing part opens the entry of the second air passage.

6. The TDR damper of claim 5, wherein the first air passage and the second air passage are separated from each other until reaching the outlets connected to the mixer so that the air moves to the mixer through each path and the first gas passage and the second gas passage are separated from each other until reaching the outlets connected to the mixer so that the gas moves to the mixer through each path.

* * * * *